US009316177B2

(12) United States Patent
Kobayashi et al.

(10) Patent No.: US 9,316,177 B2
(45) Date of Patent: Apr. 19, 2016

(54) SADDLE-RIDE TYPE VEHICLE

(71) Applicant: HONDA MOTOR CO., LTD, Tokyo (JP)

(72) Inventors: Atsushi Kobayashi, Wako (JP); Takashi Yamamoto, Wako (JP)

(73) Assignee: HONDA MOTOR CO., LTD, Tokyo (JP)

( * ) Notice: Subject to any disclaimer, the term of this patent is extended or adjusted under 35 U.S.C. 154(b) by 128 days.

(21) Appl. No.: 14/011,328

(22) Filed: Aug. 27, 2013

(65) Prior Publication Data

US 2014/0076258 A1 Mar. 20, 2014

(30) Foreign Application Priority Data

Sep. 18, 2012 (JP) ..... 2012-204686

(51) Int. Cl.

| | |
|---|---|
| ***F02M 25/00*** | (2006.01) |
| ***F02M 35/10*** | (2006.01) |
| ***F02M 37/20*** | (2006.01) |
| ***F02M 7/12*** | (2006.01) |
| ***F02M 35/16*** | (2006.01) |
| ***F02M 5/08*** | (2006.01) |

(52) U.S. Cl.

CPC . *F02M 7/12* (2013.01); *F02M 5/08* (2013.01); *F02M 35/162* (2013.01)

(58) Field of Classification Search

CPC ..... F02M 5/08; F02M 7/12; F02M 35/024; F02M 35/162; F02M 35/02; F02M 37/20; F02M 25/0836; F02B 77/13; F02B 63/02; B60K 13/02; B60K 13/04

USPC ..... 123/198 E, 516

See application file for complete search history.

(56) References Cited

U.S. PATENT DOCUMENTS

| | | | | |
|---|---|---|---|---|
| 3,172,399 | A * | 3/1965 | Lentz et al. | 123/572 |
| 6,006,712 | A * | 12/1999 | Suzuki | 123/184.57 |
| 6,202,631 | B1 * | 3/2001 | Yamamoto et al. | 123/516 |
| 7,162,992 | B2 * | 1/2007 | Kobayashi et al. | 123/198 E |
| 2007/0012274 | A1 * | 1/2007 | Kawatani | 123/184.21 |

FOREIGN PATENT DOCUMENTS

JP 4000188 B2 10/2007

* cited by examiner

*Primary Examiner* — Lindsay Low
*Assistant Examiner* — Syed O Hasan
(74) *Attorney, Agent, or Firm* — Westerman, Hattori, Daniels & Adrian, LLP

(57) ABSTRACT

A saddle-ride type vehicle is capable of reducing influence of travelling wind on an open end of an air hose, thus preventing fluctuations in the internal pressure of a float chamber of a carburetor. The saddle-ride type vehicle includes a carburetor placed rearward of an engine and an air cleaner placed rearward of the carburetor. An air hose configured to regulate the internal pressure of a float chamber of the carburetor is connected to the carburetor. A recessed portion is provided at a side wall of an air-cleaner case of the air cleaner, the side wall being located along a lateral side of the vehicle. An open end of the air hose is placed at the recessed portion of the air-cleaner case.

10 Claims, 7 Drawing Sheets

SADDLE-RIDE TYPE VEHICLE

CROSS-REFERENCE TO RELATED APPLICATIONS

The present application claims priority under 35 U.S.C. §119 to Japanese Patent Application No. 2012-204686, filed Sep. 18, 2012, the contents of which are incorporated herein, by reference, in their entirety.

TECHNICAL FIELD

The present invention relates to a saddle-ride type vehicle, and relates specifically to an air hose configured to regulate the internal pressure of a float chamber of a carburetor of a saddle-ride type vehicle.

BACKGROUND OF THE INVENTION

In a conventionally known saddle-ride type vehicle, an open end of an air hose connected to a carburetor is placed frontward of an air-cleaner case (see, for example, Japanese Patent No. 4000188).

SUMMARY OF THE INVENTION

In the saddle-ride type vehicle described in Japanese Patent No. 4000188 given above, being placed frontward of the air cleaner case, the open end of the air hose is easily influenced by travelling wind, and thereby the internal pressure of the float chamber of the carburetor tends to fluctuate. To prevent the influence of travelling wind, a vehicle cover needs to be increased in size, and this might degrade the appearance of the vehicle.

A saddle-ride type vehicle capable of reducing the influence of travelling wind on the open end of the air hose and thus preventing fluctuations in the internal pressure of the float chamber of the carburetor.

A first aspect provides a saddle-ride type vehicle including a carburetor placed rearward of an engine and an air cleaner placed rearward of the carburetor, the vehicle comprising an air hose connected to a float chamber of the carburetor and configured to regulate an internal pressure of the float chamber. A recessed portion is provided at a side wall of an air-cleaner case of the air cleaner, the side wall being located along a lateral side of the vehicle, and an open end of the air hose is placed at the recessed portion of the air-cleaner case.

In a second aspect, the recessed portion has a flange portion formed at the side wall of the air-cleaner case and a guide wall extending downward from the flange portion, and the open end of the air hose is placed inward of the guide wall.

In a third aspect, an air-hose cap is attached to the open end of the air hose; a U-shaped notch portion is formed in the guide wall, a width of the air-hose cap is set to be larger than a width of the notch portion, and the air-hose cap functions as a retainer for preventing the air hose from coming off from the notch portion.

In a fourth aspect, an opening of the air-hose cap is formed into a tapered face to expand in diameter in a tapered manner, and the air-hose cap is placed inward of the guide wall with the tapered face facing downward.

In a fifth aspect, the air-cleaner case includes a case body and a cover portion closing the case body; and the flange portion is a fastening boss configured to fasten the cover portion to the case body.

In a sixth aspect, an intermediate locking portion configured to lock an intermediate portion of the air hose is provided on an upper face of the cover portion of the air-cleaner case.

According to the first aspect, the saddle-ride type vehicle includes the air hose connected to the float chamber of the carburetor and configured to regulate the internal pressure of the float chamber, and the open end of the air hose is placed at the recessed portion provided at the side wall of the air-cleaner case of the air cleanser, the side wall being located along a lateral side of the vehicle. Hence, the influence of travelling wind on the open end of the air hose can be reduced. Thereby, fluctuations in the internal pressure of the float chamber of the carburetor can be prevented to allow an optimum mixture ratio to be obtained constantly. The performance of the engine can thus be enhanced.

According to the second aspect, the recessed portion has the flange portion formed at the right wall of the air-cleaner case and the guide wall extending downward from the flange portion, and the open end of the air hose is placed inward of the guide wall. Hence, the guide wall can be formed using a mold for forming the flange portion. This contributes to a reduction in cost for manufacturing the air-cleaner case.

According to the third aspect, the air-hose cap functions as a retainer for preventing the air hose from coming off from the notch portion. Hence, assemblage and maintenance of the vehicle can be improved.

According to the fourth aspect, the opening of the air-hose cap is formed into a tapered face to expand in its diameter in a tapered manner, and the air-hose cap is placed inward of the guide wall with the tapered-face facing downward. Hence, the air-hose cap can be protected from rain and the like by the guide wall. Further, the opening of the air-hose cap is made large because of the tapered face, and fluctuations in the internal pressure of the air hose due to attachment of mud or the like can be reduced. Hence, an even better mixture ratio can be obtained to further enhance the performance of the engine.

According to the fifth aspect, the flange portion is the fastening boss configured to fasten the first cover portion to the case body. Hence, without affecting the capacity of the air cleaner, the air hose can be held firmly to the guide wall formed to be continuous with the fastening boss.

According to the sixth aspect, the intermediate locking portion is provided on the upper face of the first cover portion to lock the intermediate portion of the air hose. Hence, the air hose extending from the carburetor can be placed in an upward-inclined posture. Consequently, fluctuations in the internal pressure of the air hose due to fuel, dew, or the like remaining inside the air hose can be reduced. Thus, an even better mixture ratio can be obtained to further enhance the performance of the engine.

BRIEF DESCRIPTION OF THE DRAWINGS

The advantages of the invention will become apparent in the following description taken in conjunction with the drawings, wherein.

DETAILED DESCRIPTION OF THE INVENTION

Figure 1:
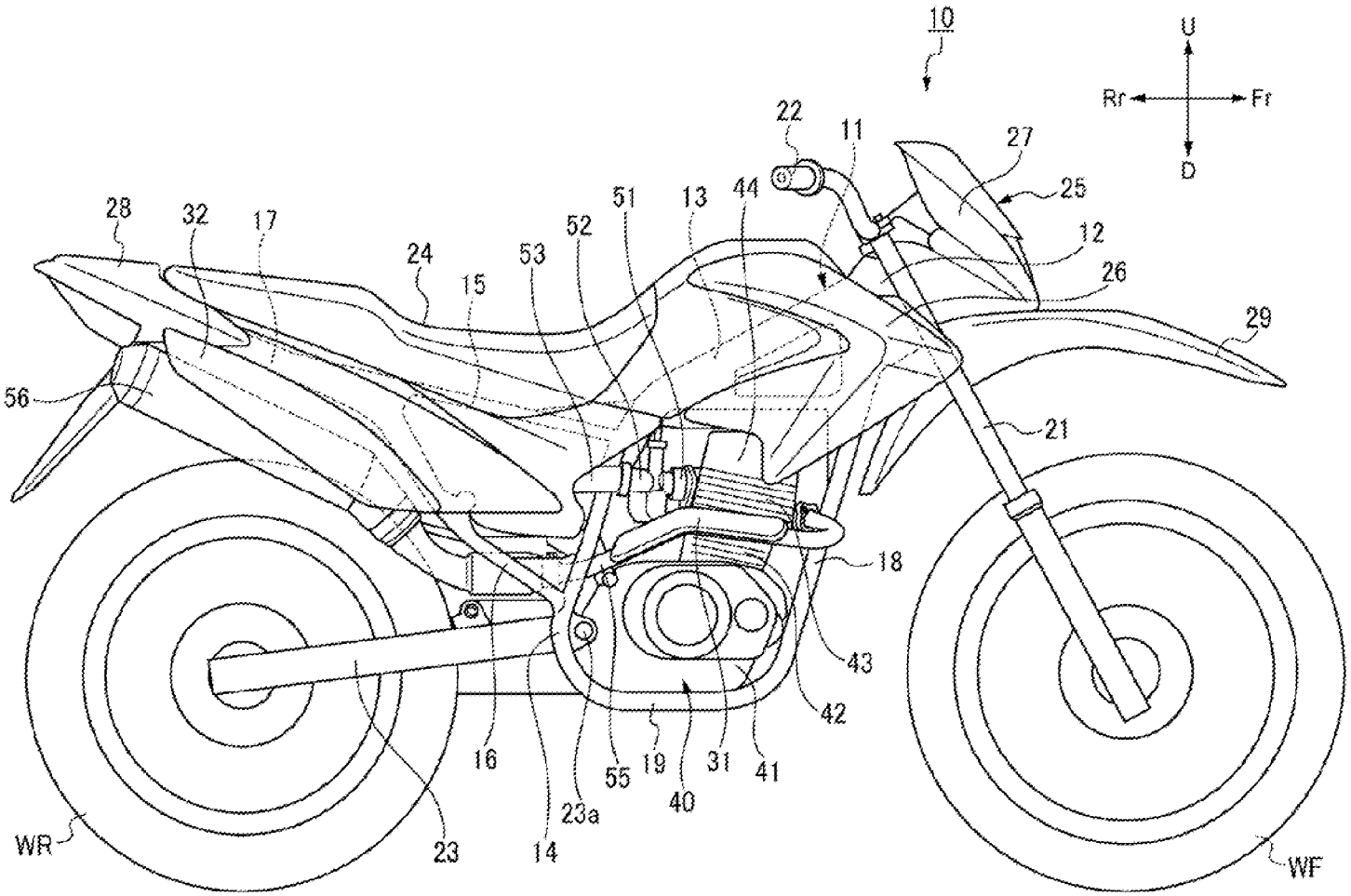
FIG. 1 is a right-side view illustrating one embodiment of a saddle-ride type vehicle according to the present invention.

With reference to the drawings, a detailed description is given below of one embodiment of a saddle-ride type vehicle according to the present invention. Note that the drawings are to be viewed along the direction of the reference numerals. In the description below, front-rear, left-right, and up-down are directions seen from a driver. In the drawings, front is denoted as Fr, rear as Rr, left as L, right as R, up as U, and down as D.

As shown in FIG. 1, a motorcycle (saddle-ride type vehicle) 10 according to this embodiment includes: a head pipe 12 at the front end of which a vehicle frame 11 is provided; a main frame 13 extending rearward and downward from the head pipe 12; paired left and right pivot frames 14 extending downward from a rear end portion of the main frame 13; paired left and right rear frames 15 connected to respective upper end portions of the pivot frames 14 and extending downward therefrom; paired left and right sub frames 16 connected to respective lower end portions of the pivot frames 14 and extending rearward and upward therefrom; paired left and right rear brackets 17 to which rear end portions of the left rear frame 15 and the left sub frame 16 and rear end portions of the right rear frame 15 and the right sub frame 16 are connected, respectively; a down frame 18 extending downward from the head pipe 12; and paired left and right bottom frames 19 connecting a lower end portion of the down frame 18 to the paired left and right pivot frames 14. An engine 40 is attached to a space surrounded by the main frame 13, the pivot frames 14, the down frame 18, and the bottom frames 19.

The motorcycle 10 further includes: a front fork 21 steerably supported at the head pipe 12; a front wheel WF rotatably supported at lower end portions of the front fork 21; a steering handle 22 attached to an upper end portion of the front fork 21; a swing arm 23 swingably supported by the pivot frames 14 via a pivot shaft 23*a*; a rear wheel WR rotatably supported at rear end portions of the swing arm 23; and a seat 24 attached to the rear frames 15.

A vehicle body of the motorcycle 10 is covered with a vehicle cover 25. The vehicle cover 25 includes shrouds 26 covering the respective sides of the main frame 13 and the down frame 18, a front cowl 27, and a rear cowl 28. In FIG. 1, reference numeral 29 denotes a front fender, reference numeral 31 denotes an exhaust-pipe cover, and reference numeral 32 denotes a muffler cover.

As shown in FIG. 1, an outer shell of the engine 40 mainly includes a crankcase 41, a cylinder block 42 attached to a front upper end portion of the crankcase 41, a cylinder head 43 attached to an upper end portion of the cylinder block 42, and a cylinder-head cover 44 covering an opening at an upper portion of the cylinder head 43.

Figure 2:
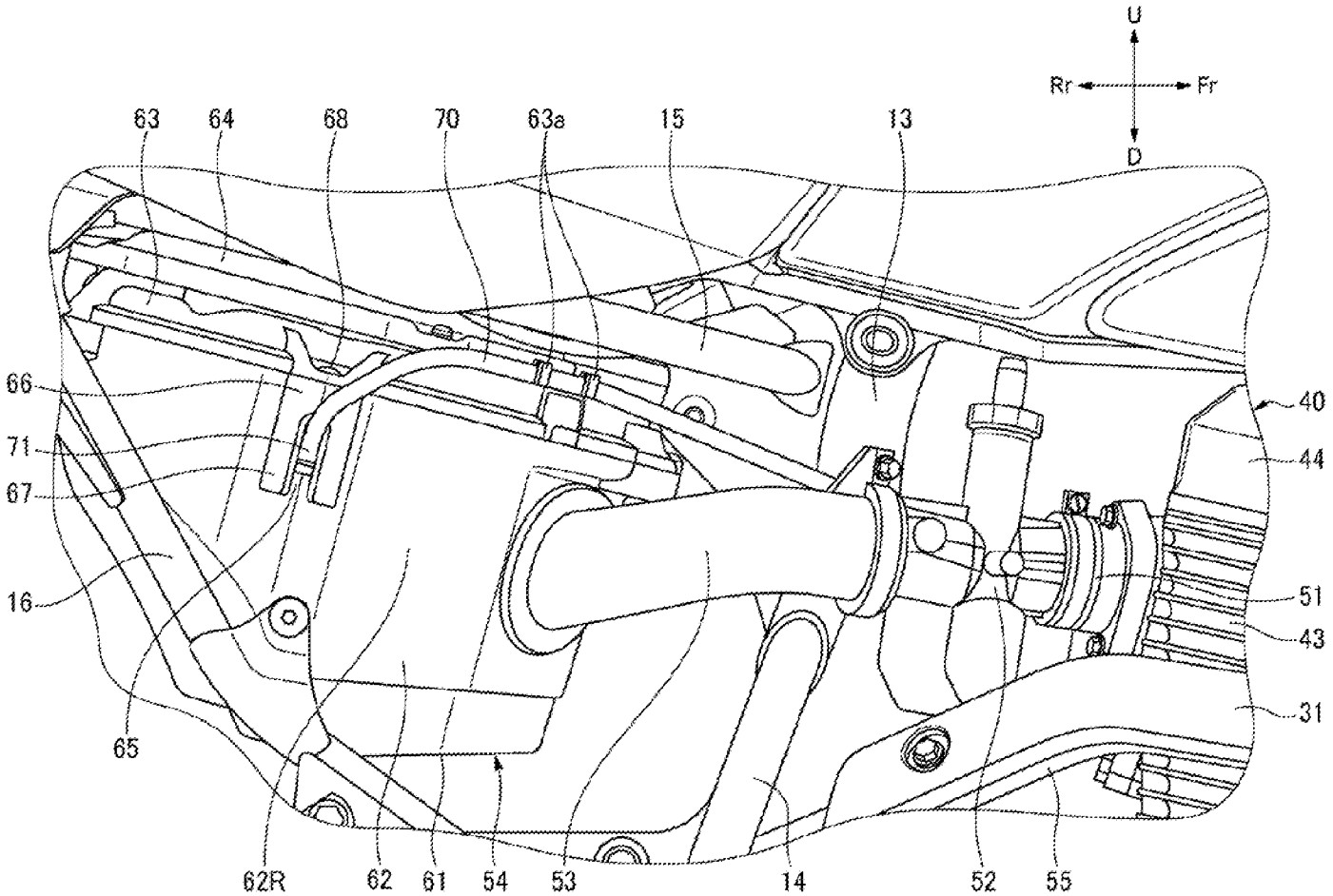
FIG. 2 is an enlarged right-side view of an area surrounding a carburetor shown in FIG. 1.

As shown in FIGS. 1 and 2, a carburetor 52 is connected to a rear face of the cylinder head 43 via a suction pipe 51, and an air cleaner 54 is connected to an upstream end of the carburetor 52 via a connection pipe 53. Hence, the carburetor 52 is placed rearward of the cylinder head 43, and the air cleaner 54 is placed rearward of the carburetor 52. Further, a muffler 56 is connected to a front face of the cylinder head 43 via an exhaust pipe 55.

Figure 3:
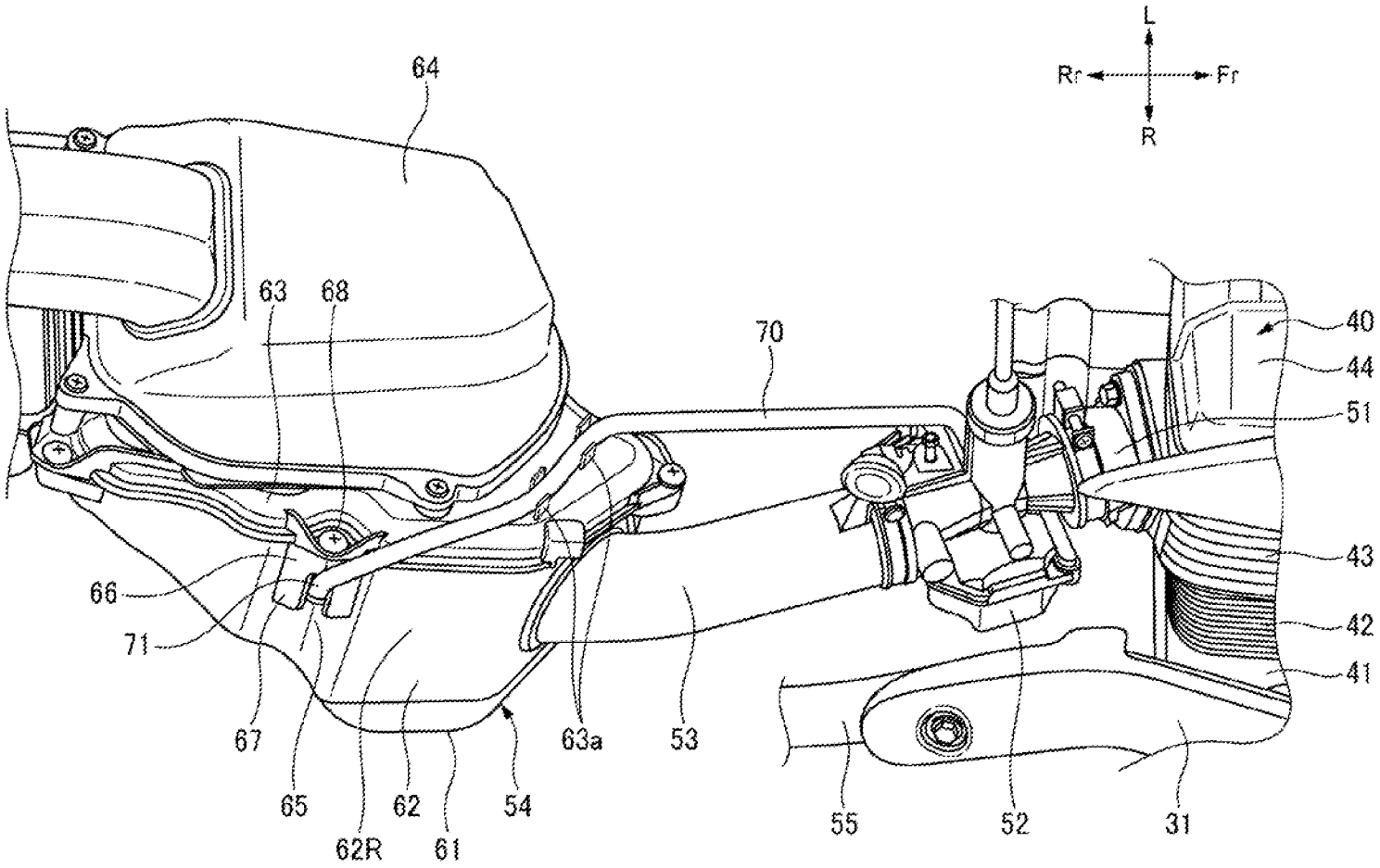
FIG. 3 is a perspective view of an area surrounding the carburetor shown in FIG. 2, seen from the right.

As shown in FIGS. 2 and 3, the air cleaner 54 includes an air-cleaner case 61 which includes a case body 62 and first and second cover portions 63 and 64 which close an opening of the case body 62 at an upper portion thereof.

Figure 4:
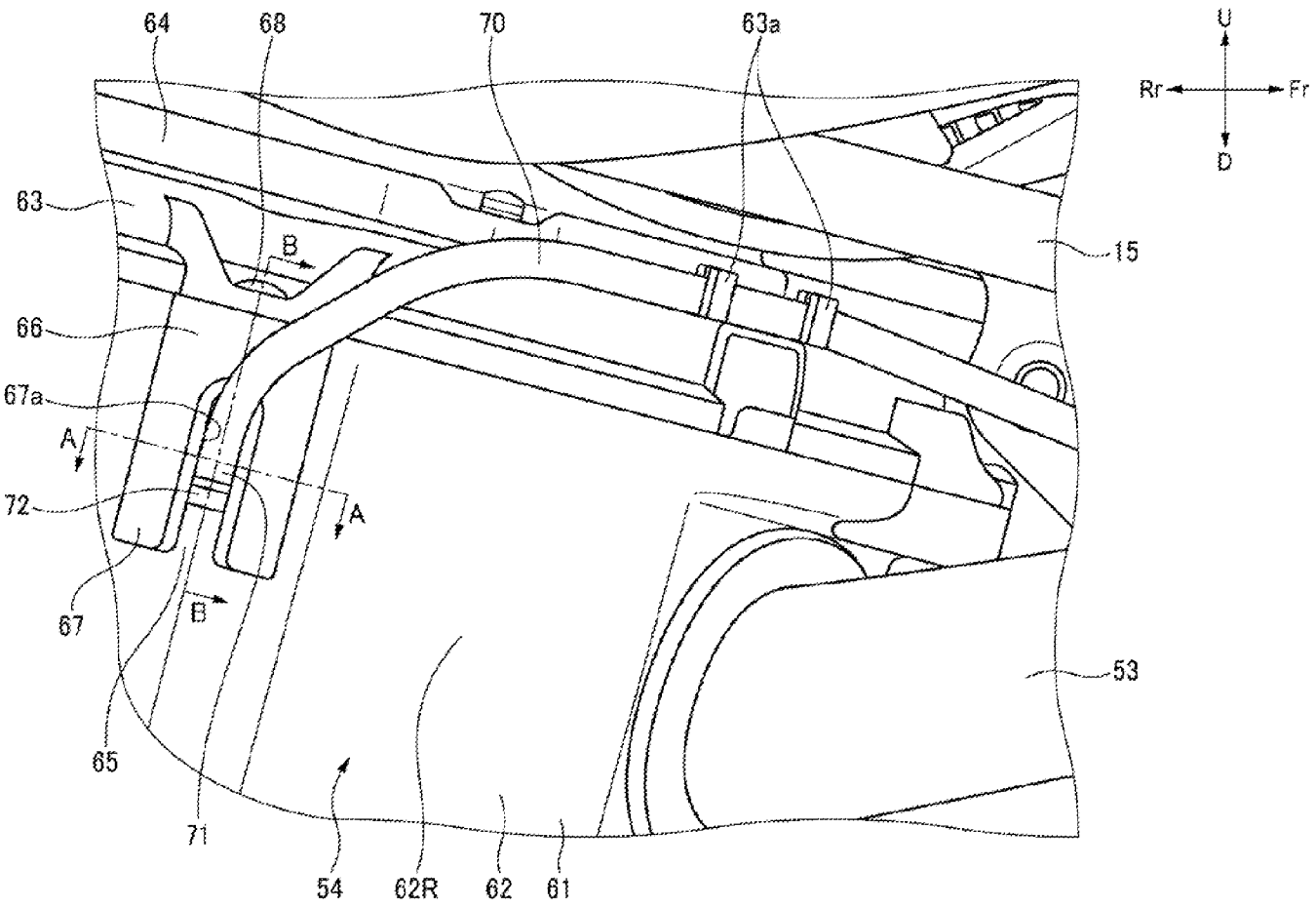
FIG. 4 is an enlarged right-side view of an area surrounding an open end of an air hose shown in FIG. 2.
Figure 5:
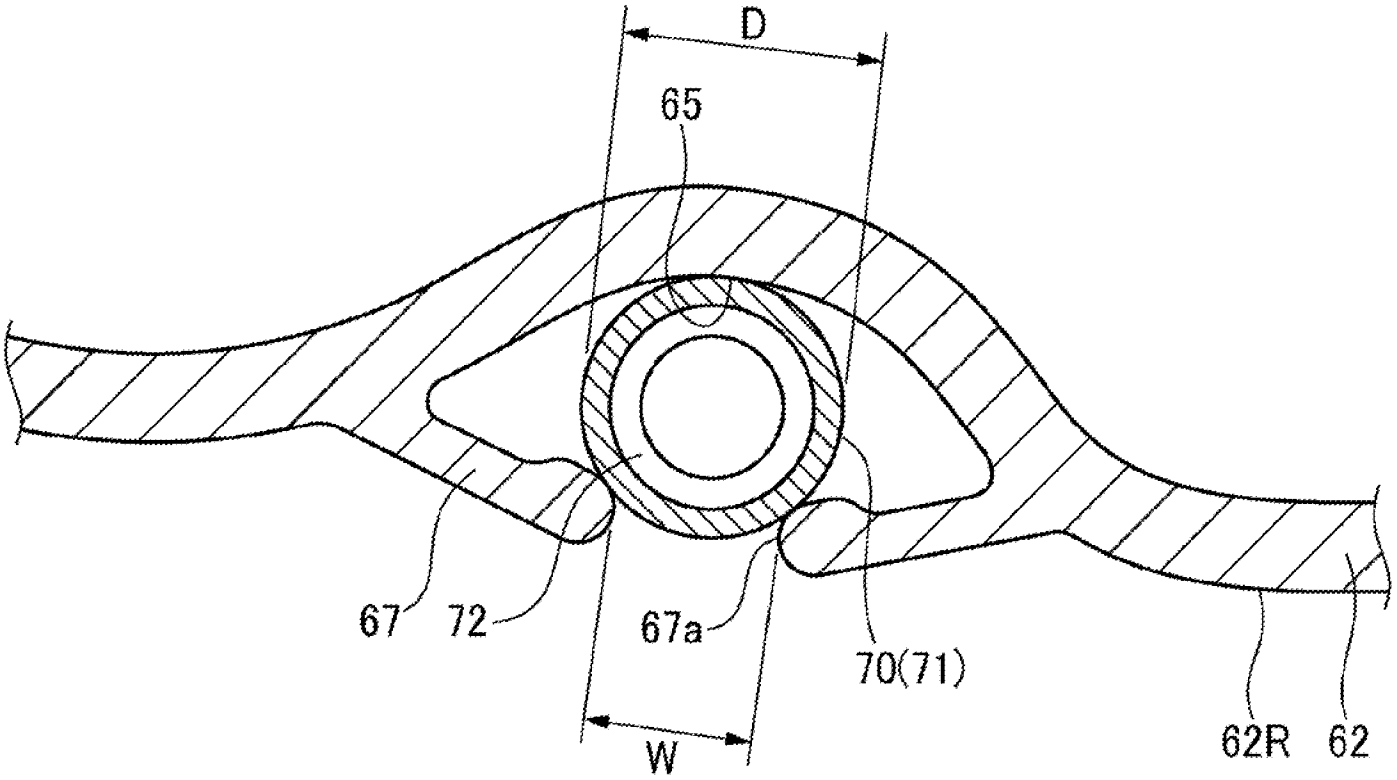
FIG. 5 is a sectional view taken along line A-A in FIG. 4.
Figure 6:
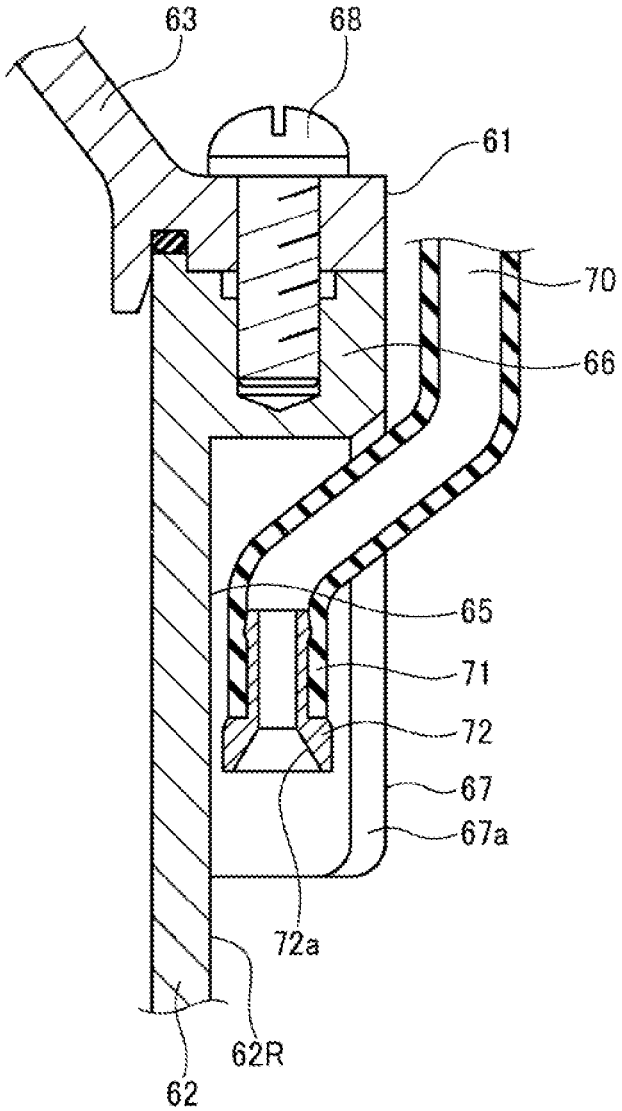
FIG. 6 is a sectional view taken along line B-B in FIG. 4.

Further, as shown in FIGS. 2 and 3, an air hose 70 is connected to a float chamber of the carburetor 52 to regulate the internal pressure of the float chamber. The air hose 70 extends rearward from the carburetor 52, extends along an upper face of the first cover portion 63 of the air-cleaner case 61, and then extends toward a right wall 62R of the case body 62 of the air-cleaner case 61. Further, as shown in FIGS. 4 to 6, an open end 71 (a rear end) of the air hose 70 is placed at a recessed portion 65 provided to the right wall 62R of the case body 62. The air hose 70 is made of a flexible material such as rubber.

As shown in FIGS. 4 to 6, the recessed portion 65 is formed at the right wall 62R of the case body 62, and has a fastening boss (flange portion) 66 configured to fasten the first cover portion 63 to the case body 62 and a guide wall 67 extending downward from the fastening boss 66. The open end 71 of the air hose 70 is placed inward of the guide wall 67. A U-shaped notch portion 67*a* is formed in a center portion of the guide wall 67, the notch portion 67*a* extending in a longitudinal direction of the guide wall 67 and opening at the bottom thereof. In FIG. 4, reference numeral 68 denotes a screw for fastening the first cover portion 63 to the case body 62.

As shown in FIGS. 4 to 7, a substantially-cylindrical air-hole cap 72 is attached to the open end 71 of the air hose 70. A diameter (width) D of the air-hole cap 72 is set to be larger than a width W of the notch portion 67*a* of the guide wall 67. Thus, the air-hose cap 72 functions as a retainer for preventing the air hose 70 from coming off from the notch portion 67*a*.

The air hose 70 is attached inside the recessed portion 65 by inserting the air-hose cap 72 to the recessed portion 65 from the notch portion 67*a* of the guide wall 67 and then pulling up a part of the air hose 70 coming out from the notch portion 67*a*.

Figure 7:
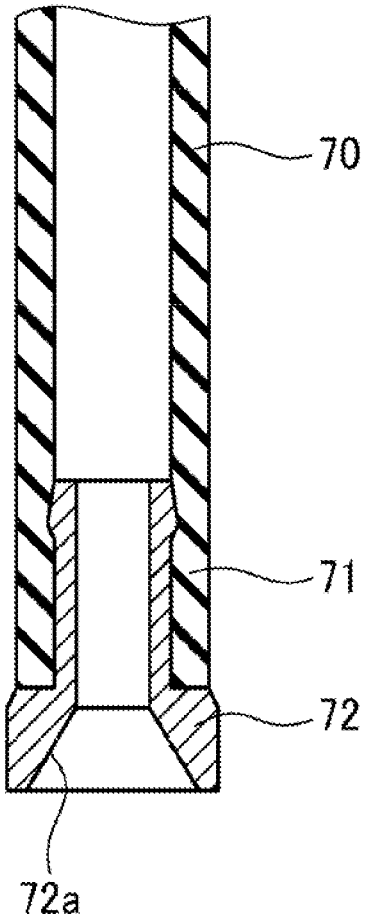
FIG. 7 is a sectional view of the air hose and an air-hose cap shown in FIG. 6.

As shown in FIGS. 6 and 7, an opening of the air-hose cap 72 is formed into a tapered face 72*a* to expand in its diameter in a tapered manner. The air-hose cap 72 is placed inward of the guide wall 67 with the tapered-face 72*a* facing downward.

As shown in FIGS. 3 and 4, two paired intermediate locking portions 63*a* are formed on the upper face of the first cover portion 63 of the air-cleaner case 61 to lock an intermediate portion of the air hose 70. The paired intermediate locking portions 63*a* are paired protruding pieces protruding upward from the upper face of the first cover portion 63, and fix the intermediate portion of the air hose 70 to the first cover portion 63 by pinching the intermediate portion of the air hose 70.

As described above, according to the motorcycle 10 of this embodiment, the open end 71 of the air hose 70 is placed at the recessed portion 65 provided at the right wall 62R of the air-cleaner case 61. Hence, the influence of travelling wind on the open end 71 of the air hose 70 can be reduced. Thereby, fluctuations in the internal pressure of the float chamber of the carburetor 52 can be prevented to allow an optimum mixture ratio to be obtained constantly. The performance of the engine can thus be enhanced.

In addition, according to the motorcycle 10 of this embodiment, the recessed portion 65 has the flange portion 66 formed at the right wall 62R of the air-cleaner case 61 and the guide wall 67 extending downward from the flange portion 66, and the open end 71 of the air hose 70 is placed inward of the guide wall 67. Hence, the guide wall 67 can be formed using a mold for forming the flange portion 66. This contributes to a reduction in cost for manufacturing the air-cleaner case 61.

Moreover, according to the motorcycle 10 of this embodiment, the air-hose cap 72 functions as a retainer for preventing the air hose 70 from coming off from the notch portion 67*a*. Hence, assemblage and maintenance of the vehicle 10 can be improved.

Further, according to the motorcycle 10 of this embodiment, the opening of the air-hose cap 72 is formed into a tapered face 72*a* to expand in its diameter in a tapered manner, and the air-hose cap 72 is placed inward of the guide wall 67 with the tapered-face 72*a* facing downward. Hence, the air-hose cap 72 can be protected from rain and the like by the guide wall 67. Further, the opening of the air-hose cap 72 is made large because of the tapered face 72*a*, and fluctuations in the internal pressure of the air hose 70 due to attachment of mud or the like can be reduced. Hence, an even better mixture ratio can be obtained to further enhance the performance of the engine.

Moreover, according to the motorcycle 10 of this embodiment, the flange portion is the fastening boss 66 configured to fasten the first cover portion 63 to the case body 62. Hence, without affecting the capacity of the air cleaner 54, the air hose 70 can be held firmly to the guide wall 67 formed to be continuous with the fastening boss 66.

Further, according to the motorcycle 10 of this embodiment, the paired intermediate locking portions 63*a* are provided on the upper face of the first cover portion 63 to lock the intermediate portion of the air hose 70. Hence, the air hose 70 extending from the carburetor 52 can be placed in an upward-inclined posture. Consequently, fluctuations in the internal pressure of the air hose 70 due to fuel, dew, or the like remaining inside the air hose 70 can be reduced. Thus, an even better mixture ratio can be obtained to further enhance the performance of the engine.

Note that the present invention is not limited to what is described in the above embodiment as an example, and can be appropriately changed without departing from the gist of the present invention.

For example, although the open end of the air hose is placed at the recessed portion of the right wall of the air-cleaner case in the embodiment, the present invention is not limited to this. Instead, the recessed portion may be provided to a left wall of the air-cleaner case to place the open end of the air hose in that recessed portion of the left wall.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

We claim:

1. A saddle-ride type vehicle, comprising:

an engine, a carburetor disposed rearward of said engine, said carburetor including a float chamber, an air cleaner disposed rearward of the carburetor, said air cleaner including an air cleaner case, and an air hose having a first end connected to said float chamber of said carburetor and configured to regulate an internal pressure of said float chamber, wherein a recessed portion is formed in an exterior face of a side wall of said air-cleaner case, said side wall being located along a lateral side of the vehicle, and wherein a second end of said air hose, which is open to the atmosphere, is disposed in said recessed portion of said air-cleaner case such that said second end of said air hose is not inserted into an interior of said air-cleaner case.

2. The saddle-ride type vehicle according to claim 1, wherein said recessed portion includes a flange portion formed on said side wall of said air-cleaner case, and a guide wall extending downward from said flange portion, and wherein said second end of said air hose is disposed inward of said guide wall.

3. The saddle-ride type vehicle according to claim 2, wherein an air-hose cap is attached to said second end of said air hose, wherein a U-shaped notch portion is formed in said guide wall, wherein a width of said air-hose cap is larger than a width of said notch portion, and wherein said air-hose cap prevents said air hose from coming off from said notch portion.

4. The saddle-ride type vehicle according to claim 3, wherein a tapered face is formed at an opening of said air-hose cap such that said opening expands in diameter in a tapered manner, and wherein said air-hose cap is disposed inward of said guide wall, with said tapered face facing downward.

5. The saddle-ride type vehicle according to claim 2, wherein said air-cleaner case includes a case body and a cover portion closing said case body, and wherein said flange portion fastens said cover portion to said case body.

6. The saddle-ride type vehicle according to claim 3, wherein said air-cleaner case includes a case body and a cover portion closing said case body, and wherein said flange portion fastens said cover portion to said case body.

7. The saddle-ride type vehicle according to claim 4, wherein said air-cleaner case includes a case body and a cover portion closing said case body, and wherein said flange portion fastens said cover portion to said case body.

8. The saddle-ride type vehicle according to claim 5, wherein an intermediate locking portion is provided on an upper face of said cover portion of said air-cleaner case, said intermediate locking portion locking an intermediate portion of the air hose to said air-cleaner case.

9. The saddle-ride type vehicle according to claim 6, wherein an intermediate locking portion is provided on an upper face of said cover portion of said air-cleaner case, said intermediate locking portion locking an intermediate portion of the air hose to said air-cleaner case.

10. The saddle-ride type vehicle according to claim 7, wherein an intermediate locking portion is provided on an upper face of said cover portion of said air-cleaner case, said intermediate locking portion locking an intermediate portion of the air hose to said air-cleaner.

* * * * *